US012473812B2

(12) United States Patent
Katterbauer et al.

(10) Patent No.: US 12,473,812 B2
(45) Date of Patent: Nov. 18, 2025

(54) METHODS AND SYSTEMS FOR LOGGING WHILE DRILLING AND OPTIMIZED TELEMETRY USING ARTIFICAL INTELLIGENCE

(71) Applicant: SAUDI ARABIAN OIL COMPANY, Dhahran (SA)

(72) Inventors: Klemens Katterbauer, Dhahran (SA); Abdallah A. AlShehri, Dhahran (SA); Ali Abdallah AlYousef, Dhahran (SA); Shouxiang Ma, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 36 days.

(21) Appl. No.: 18/412,099

(22) Filed: Jan. 12, 2024

(65) Prior Publication Data

US 2025/0230740 A1 Jul. 17, 2025

(51) Int. Cl.
*E21B 44/00* (2006.01)
*E21B 7/06* (2006.01)
(Continued)

(52) U.S. Cl.
CPC ..... *E21B 44/00* (2013.01); *E21B 47/022* (2013.01); *E21B 47/026* (2013.01); *E21B 7/06* (2013.01); *E21B 2200/22* (2020.05)

(58) Field of Classification Search
CPC ..... E21B 47/022; E21B 47/026; E21B 47/12; E21B 47/14; E21B 47/16; E21B 47/18;
(Continued)

(56) References Cited

U.S. PATENT DOCUMENTS 9,273,517 B2 * 3/2016 Tchakarov ..... E21B 47/022
9,976,415 B2 * 5/2018 Logan ..... E21B 47/135
(Continued)

FOREIGN PATENT DOCUMENTS

WO 2021/041254 A1 3/2021
WO 2023/028207 A1 3/2023

OTHER PUBLICATIONS

Gonzalez, Miguel et al., "Autonomous Viscosity/Density Sensing System for Drilling Edge-Computing System"; Proceedings of the International Petroleum Technology Conference; Paper No. IPTC-21968-MS; pp. 1-8; Feb. 21, 2022 (8 pages).
(Continued)

*Primary Examiner* — Franklin D Balseca
(74) *Attorney, Agent, or Firm* — Osha Bergman Watanabe & Burton LLP

(57) ABSTRACT

A method includes obtaining, with an edge computing device disposed in a bottom hole assembly of a drilling system, logging while drilling data. The method further includes determining, with the edge computing device, at least one interpreted quantity of a subsurface using one or more artificial intelligence (AI) models processing the logging while drilling (LWD) data. The method further includes determining, with the edge computing device, an optimal set of data transfer parameters for a telemetry system governed by a set of data transfer parameters, to telemeter the at least one interpreted quantity, where the set of data transfer parameters are continually updated to the optimal set of data transfer parameters while the logging while drilling data is being acquired. The method further includes transmitting, with the edge computing device, one or more guidance control parameters to a geosteering system based on the at least one interpreted quantity.

17 Claims, 8 Drawing Sheets

(51) Int. Cl.
*E21B 47/022* (2012.01)
*E21B 47/026* (2006.01)

(58) Field of Classification Search
CPC ..... E21B 47/20; E21B 47/22; E21B 47/24; E21B 7/06; E21B 2200/22; E21B 44/00
See application file for complete search history.

(56) References Cited

U.S. PATENT DOCUMENTS

| | | | | |
|---|---|---|---|---|
| 10,329,900 | B2 | 6/2019 | Chen et al. | |
| 11,434,743 | B2 | 9/2022 | Boone et al. | |
| 12,265,195 | B2 * | 4/2025 | Combs | E21B 49/00 |
| 2015/0346234 | A1 * | 12/2015 | Campbell | E21B 47/12 73/152.43 |
| 2019/0048703 | A1 | 2/2019 | Samuel et al. | |
| 2022/0231933 | A1 * | 7/2022 | Mannor | G06N 3/08 |
| 2023/0084202 | A1 * | 3/2023 | Patil | G16H 30/20 726/26 |

OTHER PUBLICATIONS

Wang, Ruijia et al., "Accurately Estimating Shear Slowness Using Data-Driven Quadrupole Sonic Logging-While-Drilling Data Processing"; Proceedings of the SPWLA 60th Annual Logging Symposium; Paper No. SPWLA-2019-U; pp. 1-7; Jun. 15, 2019 (7 pages).

Qun, Peng et al., "Application Status of the Technology of Logging While Drilling"; Advanced Materials Research; vols. 1010-1012; pp. 1650-1653; 2014 (4 pages).

Rodríguez-Rozas, Ángel et al., "A Priori Fourier Analysis for 2.5D Finite Elements Simulations of Logging-While-Drilling (LWD) Resistivity Measurements"; Procedia Computer Science; vol. 80; pp. 782-791; 2016 (10 pages).

Alsheikh, Mohammed et al., "Internet of Things IoT Edge Computer Vision Systems on Drilling Rigs"; Proceedings of the SPE Middle East Oil & Gas Show and Conference; Paper No. SPE-204757-MS; pp. 1-14; Dec. 15, 2021 (14 pages).

Geekiyanage, Suranga C. H. et al., "Drilling data quality improvement and information extraction with case studies"; Journal of Petroleum Exploration and Production Technology; vol. 11, Issue 2; pp. 819-837; Feb. 2021 (19 pages).

* cited by examiner

METHODS AND SYSTEMS FOR LOGGING WHILE DRILLING AND OPTIMIZED TELEMETRY USING ARTIFICAL INTELLIGENCE

BACKGROUND

When planning the path of a well, it is advantageous to know the lithology, saturation, and associated physical properties of subsurface rock formations at the drill bit of a drilling system while drilling. This allows preemptive wellbore trajectory changes to be made before the wellbore reaches its target zone, e.g., a hydrocarbon reservoir, and to maintain the wellbore in the target zone. Information used to update the path of the well may be derived from a suite of logging while drilling (LWD) tools configured as part of the bottom hole assembly of the drilling system. A measurement acquired using a LWD tool is typically recorded and stored as a function of depth and/or time as the drill bit penetrates and traverses the subsurface, the recorded and stored measurement known as a LWD log. Given a suite of LWD tools, multiple LWD logs ("logs") may be acquired where both the independent and joint evaluation of the logs can be used to determine properties of the subsurface (e.g., lithology) proximate the drill bit.

Logging while drilling (LWD) logs are typically telemetered from the bottom hole assembly to the surface for analysis and interpretation and are used to adjust and steer the drill bit (i.e., geosteering). However, there is often a significant constraint on the quantity and transmission speed of telemetered logs. For example, mud pulse telemetry (MPT) is often associated with low transmission rates, channel distortion, and noise interference. Thus, the quantity of LWD data that can be used to inform geosteering decisions is limited. Further, real time analysis of high-resolution logs is difficult, if not prevented.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein generally relate to a method that includes obtaining, with an edge computing device disposed in a bottom hole assembly of a drilling system, logging while drilling data acquired while drilling a well through a subsurface with the drilling system. The method further includes determining, with the edge computing device, at least one interpreted quantity of the subsurface using one or more artificial intelligence (AI) models processing the logging while drilling (LWD) data. The method further includes determining, with the edge computing device, an optimal set of data transfer parameters for a telemetry system of the drilling system that is governed by a set of data transfer parameters, to telemeter the at least one interpreted quantity, where the set of data transfer parameters are continually updated to the optimal set of data transfer parameters while the logging while drilling data is being acquired. The method further includes transmitting, with the edge computing device, one or more guidance control parameters to a geosteering system of the drilling system based on the at least one interpreted quantity.

Embodiments disclosed herein generally relate to a non-transitory computer-readable memory comprising computer-executable instructions stored thereon that, when executed on a processor, cause the processor to perform steps. The steps include obtaining logging while drilling data acquired while drilling a well through a subsurface with a drilling system and determining at least one interpreted quantity of the subsurface using one or more artificial intelligence (AI) models processing the logging while drilling (LWD) data. The steps further include determining an optimal set of data transfer parameters for a telemetry system of the drilling system that is governed by a set of data transfer parameters, to telemeter the at least one interpreted quantity, where the set of data transfer parameters are continually updated to the optimal set of data transfer parameters while the logging while drilling data is being acquired. The steps further include transmitting one or more guidance control parameters to a geosteering system of the drilling system based on the at least one interpreted quantity.

Embodiments disclosed herein generally relate to a system including a drilling system with a bottom hole assembly. The drilling system further includes a drill bit to drill a well in a subsurface, a suite of logging while drilling (LWD) tools with at least one logging while drilling tool proximate the drill bit, an edge computing device configured to obtain logging while drilling data from the suite of LWD tools while drilling the well through the subsurface with the drilling system, and a telemetry system governed by a set of data transfer parameters and configured to telemeter data from the bottom hole assembly to a surface. The edge computing device is further configured to determine at least one interpreted quantity of the subsurface using one or more artificial intelligence (AI) models processing the logging while drilling (LWD) data and determine an optimal set of data transfer parameters for the telemetry system to telemeter the at least one interpreted quantity. The edge computing device is further configured to transmit one or more guidance control parameters to a geosteering system of the drilling system based on the at least one interpreted quantity.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
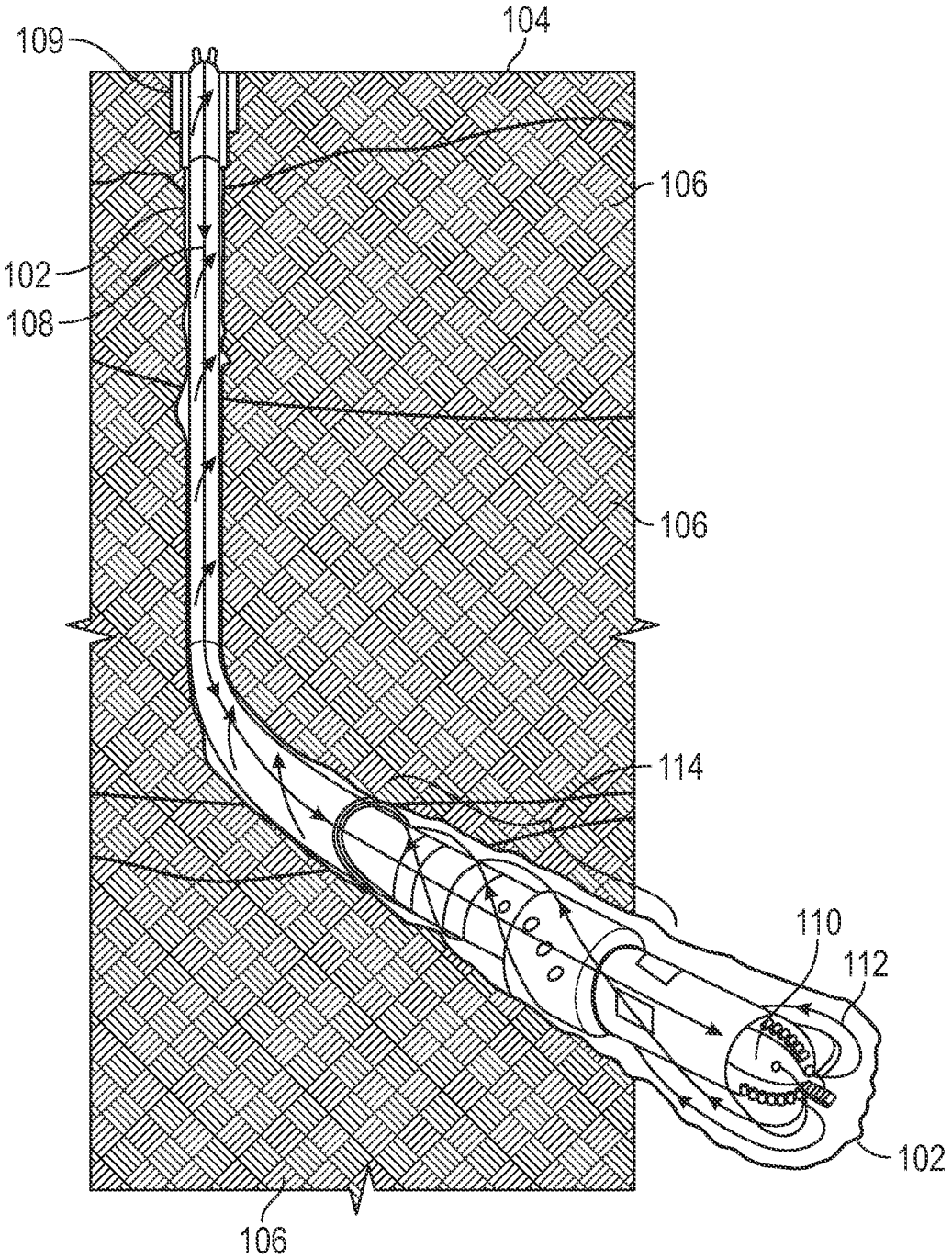
FIG. 1 depicts a logging-while-drilling operation in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. For example, a "logging while drilling log (or, more simply, a log)," may include any number of "logging while drilling logs (or, more simply, logs)," without limitation.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

In the following description of FIGS. 1-10, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Embodiments disclosed herein generally relate to an edge computing device, such as a microprocessor, disposed as part of the bottom hole assembly (BHA) of a drilling system. The edge computing device receives logging while drilling (LWD) data (i.e., one or more LWD logs) from a suite of LWD tools, processes the LWD data with one or more artificial intelligence (AI) models to determine properties of the subsurface proximate the drill bit in real time, and further optimizes telemetry of transferred information from the BHA to the surface, where that transferred information may be some LWD data, determined properties, or some combination thereof. A LWD log can be categorized according to the type of tool used and/or the type of measured value (e.g., voltage, current, etc.), where this categorization is described herein as a data type of the LWD log. As such, LWD data may be composed of more than one LWD log, each log having a data type and a data size. In one or more embodiments, the edge computing device processes LWD data with the one or more AI models based on the data type and data size. For example, in one or more embodiments, the an AI model is provided and specified to process each data type. LWD data, and the processed results of the one or more AI models, are stored either on a storage medium associated with the edge computing device itself or on separate and dedicated storage media disposed in the BHA.

Artificial intelligence (AI), broadly defined, is the extraction of patterns and insights from data. The phrases "artificial intelligence", "machine learning", "deep learning", and "pattern recognition" are often convoluted, interchanged, and used synonymously throughout the literature. This ambiguity arises because the field of "extracting patterns and insights from data" was developed simultaneously and disjointedly among a number of classical arts like mathematics, statistics, and computer science. For consistency, the term artificial intelligence (AI) will be adopted herein, however, one skilled in the art will recognize that the concepts and methods detailed hereafter are not limited by this choice of nomenclature.

Additionally, and in accordance with one or more embodiments, the edge computing device optimizes the transmission of data to be transferred to the surface via either wired pipe telemetry or mud pulse telemetry (MPT). The data transferring optimization involves both the determination of which data are to be prioritized to be transferred and a bandwidth and data consistency optimization. The edge computing device can directly interface with a telemetry system of the drilling system (e.g., a telemetry module of the BHA) to automatically control and adjust a set of data transfer parameters according to the data transfer optimization. As such, methods and systems disclosed herein both enhance LWD data processing and optimize the telemetry of data enabling real time data interpretation and decision making for geosteering.

A general overview of the subsurface activities associated with a drilling process are provided in FIG. 1. For brevity, in FIG. 1 above surface equipment, or other offshore rig platform and equipment, used in a drilling operation are not depicted as well sites may be configured in many ways. However, exclusion of well site configurations is not intended to be limiting. As seen, a drilling operation at a well site may include drilling a wellbore (102) into a subsurface region (106) including various formations. To drill a new section of wellbore (102), typically, a drill bit (110) with drilling fluid nozzle is connected to the down-hole end of a drill string (108), which is a series of drill pipes connected to form a conduit, and is rotated from the surface (104) while pushing the drill bit (110) against the rock forming a wellbore (102) in the ground and through the subsurface (106). In some implementations, the drill bit (110) may be rotated by a combined effect of surface rotation and with a down-hole drilling motor (not shown).

While cutting rock with a drill bit (110), typically, a drilling fluid (112) is circulated (with a pump) through the drill string (108), out of the drilling fluid nozzle of the drill bit (110), and back to the surface (104) through the presumably annular space between the wellbore (102) and the drill string (108). Moreover, the drill string (108) may contain a bottom hole assembly (BHA) (114) disposed at the distal end, or down-hole portion, of the conduit. To guide the drill bit (110), monitor the drilling process, and collect data about the subsurface (106) formations, among other objectives, the BHA (114) of the drill string (108) may be outfitted with "logging while drilling" (LWD) tools, "measurement while drilling" tools (MWD), and a telemetry module. An MWD or LWD tool is generally a sensor, or measuring device, which collects information in an associated log during the drilling process. The measurements and/or logs may be transmitted to the surface (104) using any suitable telemetry system known in the art. The BHA (114) and the drill string (108) may contain other drilling tools known in the art but not specifically stated. By means of example, common logs, or information collected by LWD tools, may include, but are not limited to, the density of the subsurface (106) formation, the effective porosity of the subsurface (106) formation, resistivity, wellbore diameter, and temperature.

Depending on the depth of hydrocarbon bearing formation and other geological complexes, a well can have several hole sizes before it reaches its target depth. A steel pipe, or casing (109), may be lowered in each hole and a cement slurry may be pumped from the bottom up through the presumably annular space between the casing (109) and the wellbore (102) to fix the casing (109), seal the wellbore (102) from the surrounding subsurface (106) formations, and ensure proper well integrity throughout the lifecycle of the well.

Upon finishing drilling the wellbore (102), the well may undergo a "completions" process to facilitate accessibility to the well and access the desired hydrocarbons. In some implementations, the final wellbore (102) can be completed using either cased and cemented pipe, which is later perforated to access the hydrocarbon, or it may be completed using a multi-stage open-hole packers assembly.

The open-hole space between sets of packers can be stimulated through an injection port in each stage allowing the hydrocarbons to flow to the surface. In the case of poor cementation, or improper sealing of packers with surrounding subsurface (106) formations, during completions, the well integrity can become compromised leading to the loss of the well or negative environmental impacts.

Figure 2:
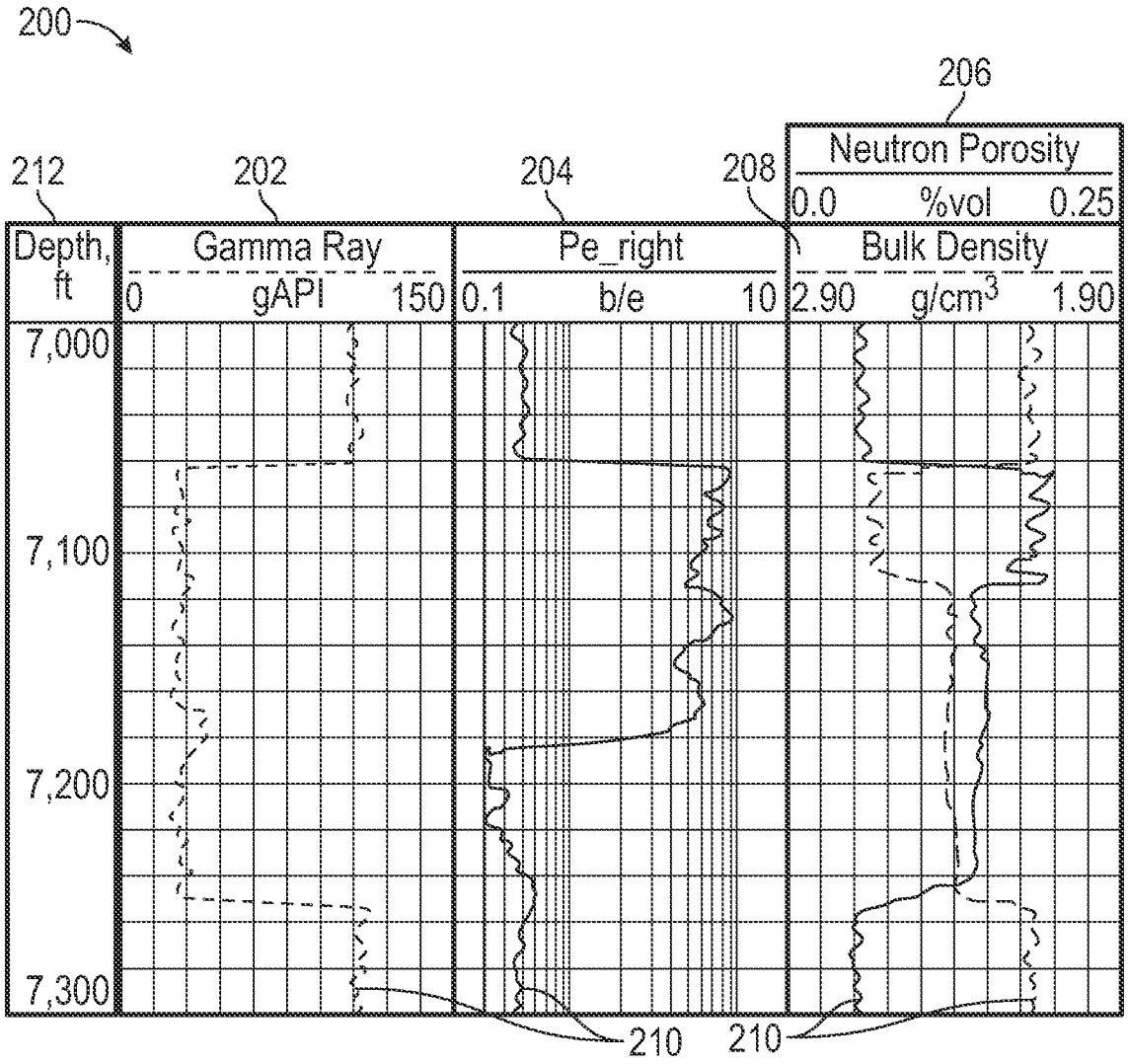
FIG. 2 shows an example of a select few logging-while-drilling logs in accordance with one or more embodiments.

FIG. 2 provides an example of LWD logs (200). Some common logs, such as a gamma ray log (202), a directional photoelectric log (direction right shown) (204), effective porosity log (206), and bulk density log (208) are shown, however, many more logs may be present during drilling operations as provided by LWD tools. Additional logs may include directional density logs and sonic logs, such as compressional and shear sonic logs. Each log is a record of log values (210) at an associated well depth (212). Here, it is noted that the term well depth (212), or more simply the depth of the wellbore (102), refers to the distance along the wellbore (102) and does not necessarily correspond with the orthogonal distance from the surface (104) where the orthogonal distance is measured along an axis oriented perpendicular to the surface (104), also known as the true vertical depth. By way of example, a portion of a wellbore (102) may be oriented horizontally, or parallel to the surface (104), such that its orthogonal distance remains fixed over the horizontal portion, however, the well depth (212) measures the distance along the wellbore (102) and is not stagnant over any horizontal portion of the wellbore (102). Additionally, the well depth (212) is continuous and strictly monotonically increasing as directed from the surface (104) to the most down-hole portion of the wellbore (102) even if the orthogonal distance, or true vertical depth, decreases.

Further, it is noted that the example LWD logs (200) of FIG. 2 are depth aligned and only one value is presented for each depth. However, in practice, while drilling a wellbore (102) the drill bit (110) does not progress through the subsurface formations (106) monotonically with time. That is, various surface or subsurface events may cause the drilling operation to be paused or for the drill bit (110) to be retracted. As such, in practice, a LWD tool may collect more than one measurement at any given depth. As noted, the example LWD logs (200) of FIG. 2 only display a single measurement value at each depth where replicate measurements at a given depth have been merged, for visualization purposes, according to a time-depth merge algorithm. Thus, while the example LWD logs (200) of FIG. 2 do not depict replicate measurements at a given depth, it is emphasized that, in general, LWD data can contain replicate measurements and that these replicate measurements can be filtered, processed, and/or used by the AI models of the edge computing device of the instant disclosure, as described later in the instant disclosure.

Drilling events that may cause a drilling operation to be paused and/or the drill bit (110) to be retracted and subsequently extended back into the wellbore (102) may include, but are not limited to: making drill string (108) connections; circulating drilling fluid (112); cleaning the wellbore (102); and removing and/or freeing drilling equipment stuck or lodged in the wellbore (102). For example, when using a top drive, drill string (108) connections are typically made every 90 feet. Further, when using a Kelly bushing and a rotary table, the drill string (108) must be retracted by 30 feet in order to add a single 30-foot section of drill pipe to the drill string (108). During the drilling operation, drilling fluid (112) may be circulated in order to control the density and/or rheology of the contents of the wellbore (102). During a period of drilling fluid (112) circulation, the drill bit (110) may be retracted by distances of hundreds of feet or more. Further, portions of the wellbore (102) may swell or otherwise constrict the wellbore (102) requiring that the drill bit (110) be retracted to make multiple cutting passes through those portions of the wellbore (102). One with ordinary skill in the art will appreciate that there are many events during a drilling operation that could trigger the need to pause, reverse, cycle, slow, or otherwise alter the progression of the drill bit (110) through one or more subsurface formations (106) during a drilling operation, such that not all possible events need be enumerated herein without posing a limitation on the instant disclosure.

As stated, to produce an LWD log with a single value for each depth, LWD logs may be processed and combined together using a time-depth merge algorithm. In general, the time-depth merge algorithm advances well depth at a specified resolution (e.g., 0.5 ft increments) and retains the first instance with respect to time. This is because the first temporal instance of recorded data at a given depth is typically considered the most representative (i.e., accurate) of the local subsurface formation (106). As such, in a single value per depth LWD log, such as the example logs (200) of FIG. 2, many measurements may be discarded. In contrast to the single value per depth LWD logs, in one or more embodiments, AI models of the instant disclosure may operate on more than one measured value at a given depth for any given LWD log.

Figure 3:
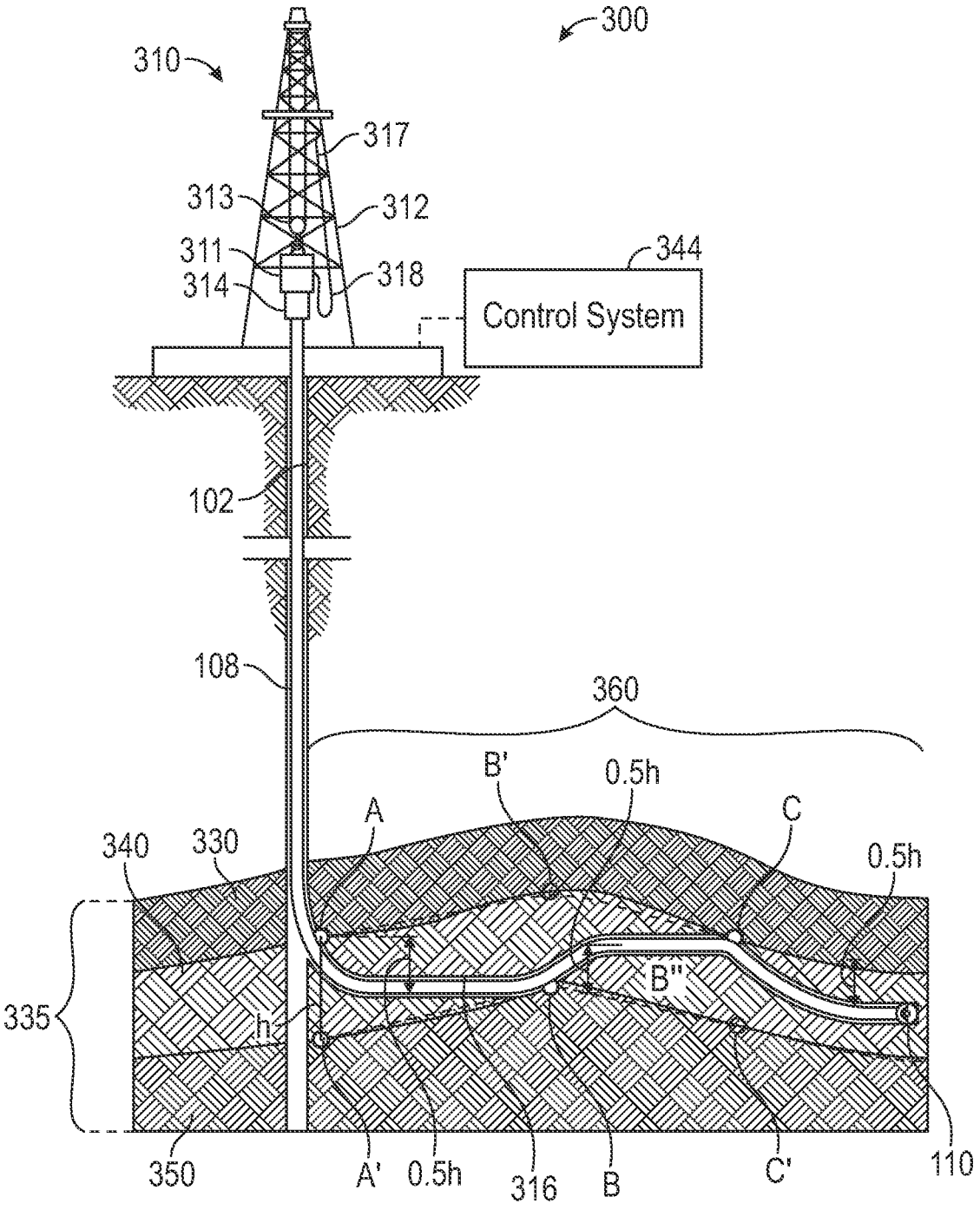
FIG. 3 depicts a geosteering drilling system in accordance with one or more embodiments.

While FIG. 1 is intended to depict subsurface activities associated with a drilling process, FIG. 3 depicts an example drilling system (300) including surface equipment, in accordance with one or more embodiments. As shown in FIG. 3, a drilling system (300) may include a top drive drill rig (310). A top drive drill rig (310) may include a top drive (311) that may be suspended in a derrick (312) by a travelling block (313). In the center of the top drive (311), a drive shaft (314) may be coupled to a top pipe of a drill string (108), for example, by threads. The top drive (311) may rotate the drive shaft (314), so that the drill string (108) and a drill bit (110) cut the rock at the bottom of a wellbore (102). A power cable (317) supplying electric power to the top drive (311) may be protected inside one or more service loops (318) coupled to a control system (344). As such, drilling mud may be pumped into the wellbore (102) through a mud line, the drive shaft (314), and/or the drill string (108).

Moreover, when completing a well, casing may be inserted into the wellbore (102). The sides of the wellbore (102) may require support, and thus the casing may be used for supporting the sides of the wellbore (102). As such, a space between the casing and the untreated sides of the wellbore (102) may be cemented to hold the casing in place. The cement may be forced through a lower end of the casing and into an annulus between the casing and a wall of the wellbore (102). More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling mud, may be pumped into the casing above the cementing plug. This displacement fluid may be pressurized fluid that serves to urge the cementing plug downward through the casing to extrude the cement from the casing outlet and back up into the annulus.

The control system (344) may receive LWD data, or other information, from the BHA (114) in order to perform various program functions for up-down steering and left-right steering of the drill bit (110) through the wellbore (102). More specifically, the control system (344) may include hardware and/or software with functionality for geosteering a drill bit through a formation in a lateral well using LWD data, such as downhole resistivity measurements. For example, the formation may be a reservoir region, such as a pay zone, bed rock, or cap rock.

The control system (344) may include hardware and/or software for managing drilling operations and/or maintenance operations. For example, the control system (344) may include one or more programmable logic controllers (PLCs) that include hardware and/or software with functionality to control one or more processes performed by the drilling system (300). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. Without loss of generality, the term "control system" may refer to a drilling operation control system that is used to operate and control the equipment, a drilling data acquisition and monitoring system that is used to acquire drilling process and equipment data and to monitor the operation of the drilling process, or a drilling interpretation software system that is used to analyze and understand drilling events and progress. Further, the control system can (344) can adjust operation of the drilling system (300).

Turning to geosteering, geosteering may be used to position the drill bit (110) or drill string (108) relative to a boundary between different subsurface layers (e.g., overlying, underlying, and lateral layers of a pay zone) during drilling operations. In particular, measuring rock properties during drilling may provide the drilling system (300) with the ability to steer the drill bit (110) in the direction of desired hydrocarbon concentrations. As such, a geosteering system may use various LWD tools located inside or adjacent to the drill string (108) to determine different rock formations within a wellbore's path. In some geosteering systems, drilling tools may use resistivity or acoustic measurements to guide the drill bit (110) during horizontal or lateral drilling.

Keeping with FIG. 3, FIG. 3 illustrates some embodiments for steering a drill bit (110) through a lateral pay zone using a geosteering system. In particular, the geosteering system may include functionality for monitoring various LWD tool signatures (e.g., an acoustic signature from acoustic sensors) that gradually or suddenly change as a well path traverses a cap rock (330), a pay zone (340), and a bed rock (350). Because of the sudden change in lithology between the cap rock (330) and the pay zone (340), for example, a sensor signature of the pay zone (340) may be different from the sensor signature of the cap rock (330). When the drill bit (110) drills out of the pay zone (340) into the cap rock (330), a detected amplitude spectrum of a particular sensor type may change suddenly between the two distinct sensor signatures. In contrast, when drilling from the pay zone (340) downward into the bed rock (350), the detected amplitude spectrum may gradually change.

During the lateral drilling of the wellbore (102), preliminary upper and lower boundaries of a formation layer's thickness may be derived from a geophysical survey and/or an offset well obtained before drilling the wellbore (102). If a vertical section (335) of the well is drilled, the actual upper and lower boundaries of a formation layer (i.e., actual pay zone boundaries (A, A')) and the pay zone thickness (i.e., A to A') at the vertical section (335) may be determined. Based on this well data, an operator may steer the drill bit (110) through a lateral section (360) of the wellbore (102). In particular, a logging tool may monitor a detected sensor signature proximate the drill bit (110), where the detected sensor signature may continuously be compared against prior sensor signatures, e.g., of the cap rock (330), pay zone (340), and bed rock (350), respectively. As such, if the detected sensor signature of drilled rock is the same or similar to the sensor signature of the pay zone (340), the drill bit (110) may still be drilling in the pay zone (340). In this scenario, the drill bit (110) may be operated to continue drilling along its current path and at a predetermined distance (0.5 h) from a boundary of a formation layer. If the detected sensor signature is same as or similar to the prior sensor signatures of the cap rock (330) or the bed rock (350), respectively, then the control system (344) may determine that the drill bit (110) is drilling out of the pay zone (340) and into the upper or lower boundary of the pay zone (340). At this point, the vertical position of the drill bit (110) at this lateral position within the wellbore (102) may be determined and the upper and lower boundaries of the pay zone (340) may be updated, (for example, positions B and C in FIG. 3). In some embodiments, the vertical position at the opposite boundary may be estimated based on the predetermined thickness of the pay zone (340), such as positions B' and C'.

While FIG. 3 shows various configurations of components, other configurations may be used without departing from the scope of the disclosure. For example, various components in FIG. 3 may be combined to create a single component. As another example, the functionality performed by a single component may be performed by two or more components.

Figure 4:
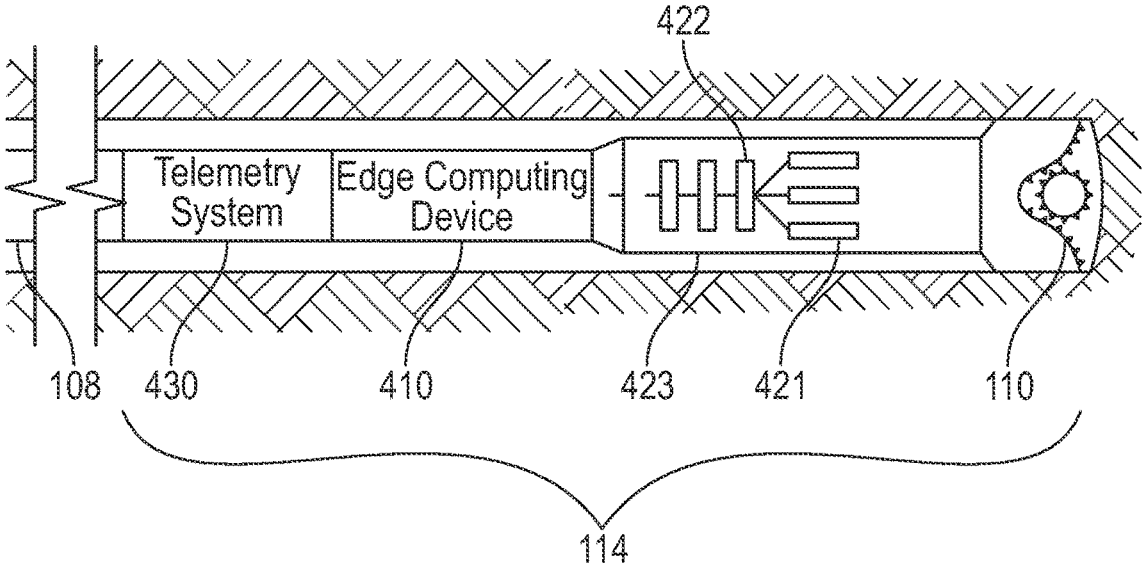
FIG. 4 depicts a bottom hole assembly in accordance with one or more embodiments.

FIG. 4 outlines an example bottom hole assembly (114) including the edge computing device (410), in accordance with one or more embodiments. The edge computing device (410) is connected to a suite of logging while drilling (LWD) tools (423) including at least one LWD tool (421). The at least one tool (421) is positioned adjacent to a drill bit (110) and coupled to the drill string (108). The suite of LWD tools may also include an analog-to-digital converter (422) for processing sensor measurements. For example, the at least one tool (421) may include acoustic sensors, such as accelerometers, measurement microphones, contact microphones, and hydrophones. Likewise, the at least one tool (421) may include other types of sensors, such as transmitters and receivers to measure resistivity, gamma ray detectors, etc. The at least one tool (421) may include hardware and/or software for generating different types of logging while drilling logs (such as acoustic logs or density logs) that may provide well data about a wellbore, including porosity of wellbore sections, gas saturation, bed boundaries in a geologic formation, fractures in the wellbore or completion cement, and many other pieces of information about a formation. In accordance with one or more embodiments, LWD data may be used to make adjustments to drilling operations. Such adjustments may include rate of penetration (ROP), drilling direction, altering mud weight, and many others drilling parameters. As depicted in FIG. 4, the edge computing device (410) is further connected to a telemetry system (430) configured by a set of data transfer parameters. In one or more embodiments, the connection between the telemetry system (430) to the edge computing device (410) allows for two-way communication and the proximate disposition of the telemetry system (430) and the edge computing device (410) ensures data communication robustness.

Figure 5:
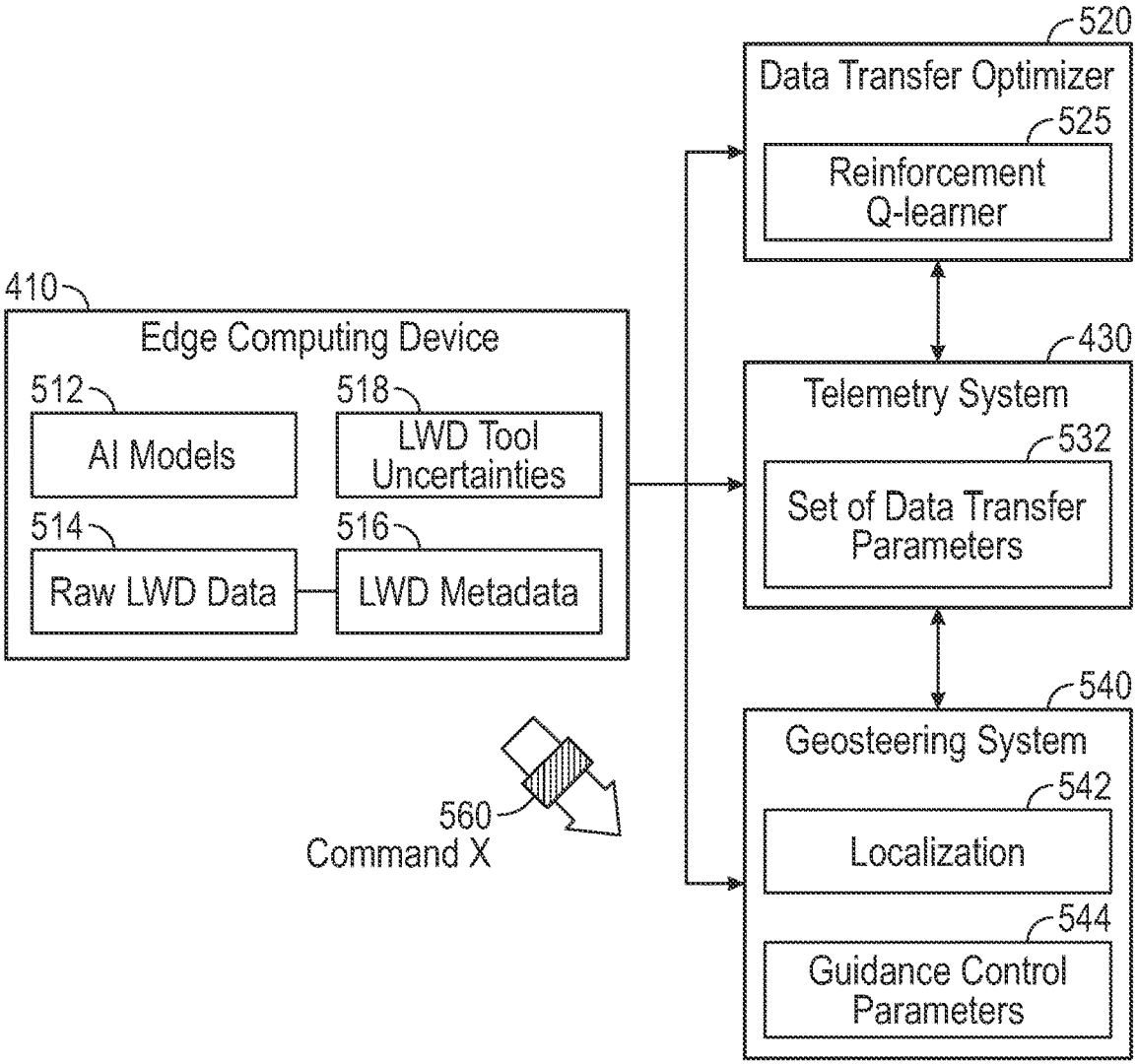
FIG. 5 depicts a system in accordance with one or more embodiments.

FIG. 5 depicts a block diagram of a system including the edge computing device (410) in accordance with one or more embodiments. In FIG. 5, the edge computing device (410) is depicted as being comprised of various components and/or modules, where the components and/or modules may interact with each other, and further interacting and/or interfacing with other systems such as a telemetry system (430) and geosteering system (540). One with ordinary skill in the art will recognize that the partitioning, organization, and interaction of the components and/or modules depicted in FIG. 5 is intended to promote clear discussion and should not be considered fixed or limiting. For example, FIG. 5 depicts a data transfer optimizer (520) as an independent entity, however, in one or more embodiments, the data transfer optimizer (520) and/or its functionality may be entirely contained and/or performed by the edge computing device (410).

As depicted in FIG. 5, the edge computing device (410) that resides in the BHA (114) of a drilling system (e.g., drilling system (300)), has access to LWD data acquired using a suite of LWD tools. In FIG. 5, the LWD data received directly from the suite of LWD tools is referenced as raw LWD data (514). In one or more embodiments, the raw LWD data (514) is associated with LWD metadata (516). The LWD metadata (516) includes, at least, information relating to the data type and data size of LWD logs of the raw LWD data (514). LWD logs included in the raw LWD data (514) may include conventional triple combo well logs, such as gamma ray, in addition to resistivity, density, neutron porosity, sonic, pressure, temperature, caliper and nuclear magnetic resonance (NMR) data. In one or more embodiments, the edge computing device (410) filters the raw LWD data (514) for outliers utilizing a z-value analysis. Additionally, the raw LWD data (514) are filtered utilizing a wavelet filtering approach to remove noise within the data. In one or more embodiments, the raw LWD data (514), after filtering, is aligned according to depth enabling the joint processing of multiple LWD logs.

The edge computing device (410) further includes one or more artificial intelligence (AI) models (512). Artificial intelligence (AI) model types may include, but are not limited to, neural networks, random forests, generalized linear models, and Bayesian regression. AI model types are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. The selection of hyperparameters surrounding a model is referred to as selecting the model "architecture." Generally, multiple model types and associated hyperparameters are tested and the model type and hyperparameters that yield the greatest predictive performance on a hold-out set of data is selected.

Once an AI model type and architecture have been selected, the AI model is typically trained using a training set of data. The training data is composed of input and target pairs. Common training techniques, such as early stopping, adaptive or scheduled learning rates, and cross-validation may be used during training without departing from the scope of this disclosure. A greater discussion surrounding AI model training is provided later in the instant disclosure.

The raw LWD data (514) (which may be filtered or otherwise preprocessed) is processed by the one or more AI models (512) to automatically determine subsurface formation parameters such as porosity, saturation, lithology. In one or more embodiments, the AI models (512) process the raw LWD data (514) based on the LWD metadata (516). For example, an AI model may be prescribed for each type of LWD log such that the LWD metadata (516) is used to dispatch a particular LWD log of the raw LWD data (514) to a particular AI model.

In one or more embodiments, the edge computing device (410) is further informed by LWD tool uncertainties (518). Physical measurements, including the measurements obtained using LWD tools, have measurement uncertainties, where the measurement uncertainty of a given LWD tool can usually be stated as range centered on the returned measurement of the tool (i.e., plus or minus some value). The measurement uncertainty of each tool is contained in the LWD tool uncertainties (518), In one or more embodiments, the LWD tool uncertainties (518) are propagated through the one or more AI models (512) when processing the raw LWD data (514) in view of the LWD metadata (516) to provide uncertainty estimates on the results (i.e., the determined subsurface formation properties/parameters).

As depicted in FIG. 5, the edge computing device (410) is directly coupled to a geosteering system (540), in accordance with one or more embodiments. The geosteering system (540), in view of the determined subsurface properties, can localize the drill bit (110) in the subsurface (i.e., localization (542)). Further, in general, the geosteering system (540) uses a set of guidance control parameters (544) to guide and alter the direction of the drill bit (110) during a drilling operation. The edge computing device (410) can issue command or control signals (e.g., command X (560)) to the geosteering system (540) to update and adjust the guidance control parameters in real time based on the processed raw LWD data (514); that is, based on the subsurface properties determined using the one or more AI models (512). As such, a planned wellbore path is continuously adapted based on continuously acquired raw LWD data (514) as the drill bit (110) penetrates the subsurface. In one or more embodiments, the guidance control parameters (544) are updated according to edge computing device (410) completely downhole, and the geosteering decisions, as well as data critical to their determination, are telemetered to the surface using the telemetry system (430).

The telemetry system (430) can use any form of telemetry known in the art to transmit data from the BHA (114) to the surface, such as wired pipe telemetry or mud pulse telemetry (MPT). Generally, there is often a significant constraint on the quantity and transmission speed of data telemetered from the BHA (114) to the surface. For example, MPT is often associated with low transmission rates, channel distortion, and noise interference. In one or more embodiments, the edge computing device is connected to or contains a data transfer optimizer (520) that interacts with the telemetry system (430) to optimize the transfer of data from the BHA (114) to the surface. In one or more embodiments, data transmission using the telemetry system (430) is governed by a set of data transfer parameters (532). The data transfer optimizer (520) determines which data are to be prioritized to be transferred, followed by a bandwidth and data consistency optimization. Upon optimization, the set of data transfer parameters (532) are automatically updated in the telemetry system (430). The effectiveness of the set of data transfer parameters (532) are continually monitored in terms of bandwidth and latency. In one or more embodiments, the data transfer optimizer (520) is or includes a reinforcement Q-learner (525) that learns or otherwise adjusts the set of data transfer parameters (532) based on the processed raw LWD data (514) (processed using the one or more AI models (512)) in view of both the LWD metadata (516) and observable telemetry metrics such as bandwidth and latency.

In accordance with one or more embodiments, the data transfer optimizer (520) improves the bandwidth and latency of telemetered data through one or more of the following methods. First, raw LWD data (514), which is typically very large, is reduced by interpreting the raw LWD data (514) to useful subsurface properties downhole (i.e., without the need to telemeter the raw LWD data (514)) using the one or more AI models (512). Thus, interpreted results, which typically have a smaller data size than their raw LWD data counterpart, can be telemetered to the surface instead of the raw LWD data (514) itself. Second, data to be telemetered to prioritized by the data transfer optimizer (520). Basic or already interpreted properties such as lithology, porosity, saturation, and bound fluid volume are given higher priority by the data transfer optimizer (520) than more data intensive (in terms of data size) measurements such as borehole images and NMR T2 distributions for rock pore structure characterization. Third, bandwidth and data consistency are implemented by the data transfer optimizer via changing the frequency data transmission of the mud pulse or wired connection while simultaneously ensuring that the data maintain consistency and the error rates during the transmission are not excessive, such as experiencing data losses. Finally, in one or more embodiments, the data transfer optimizer (520) uses a reinforcement learning approach (e.g., reinforcement Q-learner (525)) that changes transfer bandwidth and frequency to maximize data transfer rates depending on amount of data to be transmitted and the current telemetry conditions.

Turning to reinforcement learning, a reinforcement learning algorithm may train an artificial intelligence model (where, here, the AI model is part of the data transfer optimizer (520)) to make a sequence of decisions. For example, a recurrent neural network (RNN) may be trained by a reinforcement learning algorithm to achieve a predetermined objective in a possibly uncertain, potentially complex environment. In particular, the predetermined objective may be an optimal set of data transfer parameters. Thus, a reinforcement learning algorithm may employ a trial-and-error procedure to determine a solution to a complex problem. For example, a reinforcement learning algorithm may include a reward function that teaches a recurrent neural network (RNN) to follow certain rules, while still allowing the network to retain information learned from filtered, processed (e.g., using the AI models (512)), and prioritized LWD data.

Figure 6:
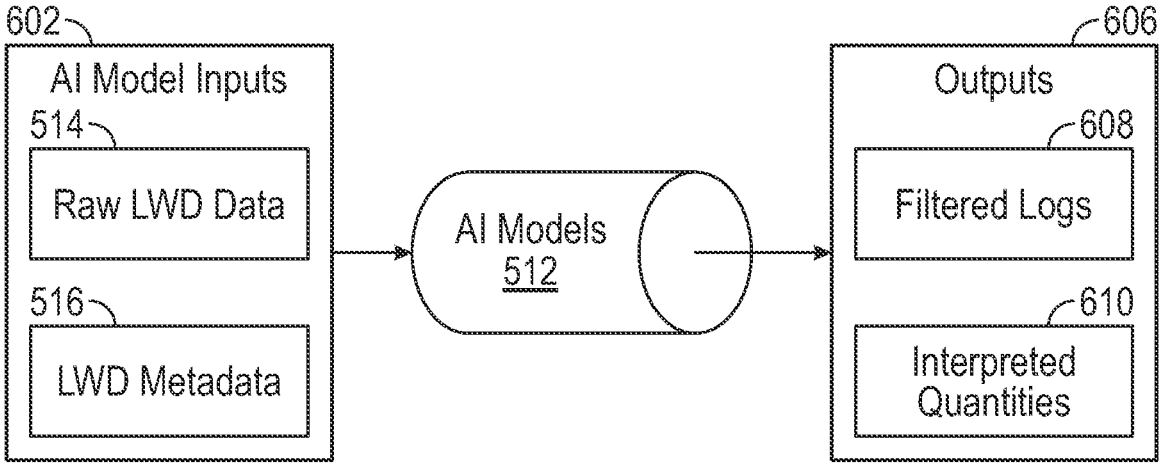
FIG. 6 depicts a system in accordance with one or more embodiments.

FIG. 6 depicts the use of the one or more AI models (512) to predict outputs (606) including, at least, interpreted quantities (610) such as subsurface formation properties (e.g., lithology, porosity, etc.). The predicted outputs (606) may further include filtered logs (608) where, at least, outlier values have been removed from the raw LWD data (514). In accordance with one or more embodiments, and as depicted in FIG. 6, the AI model inputs (602) include raw LWD data (514) and the LWD metadata (516). In one or more embodiments, one or more LWD logs are identified in the raw LWD data (514) using the LWD metadata (516) and dispatched to a particular AI model of the one or more AI models (512). That is, when the one or more AI models (512) includes at least two AI models, each AI model may be configured to perform an individual task, such as predicting only one subsurface property, based on a LWD log (or a subset of LWD logs) from the raw LWD data (514).

Figure 7:
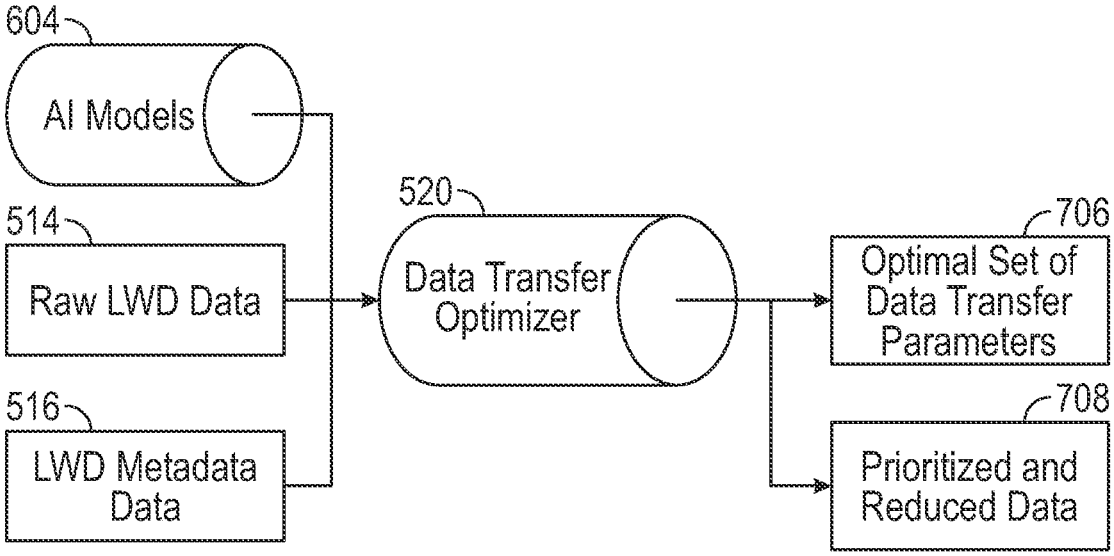
FIG. 7 depicts a system in accordance with one or more embodiments.

FIG. 7 depicts the use of the data transfer optimizer (520) to determine, at least, an optimal set of data transfer parameters (706). In one or more embodiments, the data transfer optimizer (520) further selects reduced data (e.g., interpreted quantities (610)) and determines which data are to be prioritized to be transferred (i.e., prioritized and reduced data (708)). The data transfer optimizer operates on the raw LWD data (514) in view of the LWD metadata (516) and further makes use of the AI models (512) (e.g., using the result of the AI models (512) such as the interpreted quantities (610)). In one or more embodiments, the data transfer optimizer contains or is itself an AI model (e.g., reinforcement Q-learner (525)). The effectiveness of the set of data transfer parameters (532) are continually monitored in terms of bandwidth and latency. Based on the continually monitored metrics, and using the continually acquired raw LWD data (514) (and associated updated LWD metadata (516) and interpreted quantities (610)), the data transfer optimizer (520) automatically adjusts the set of data transfer parameters (532) to the optimal set of data transfer parameters (706) and further instructs and/or commands the telemetry system to transmit data according to the prioritized and reduced data (708).

Figure 8:
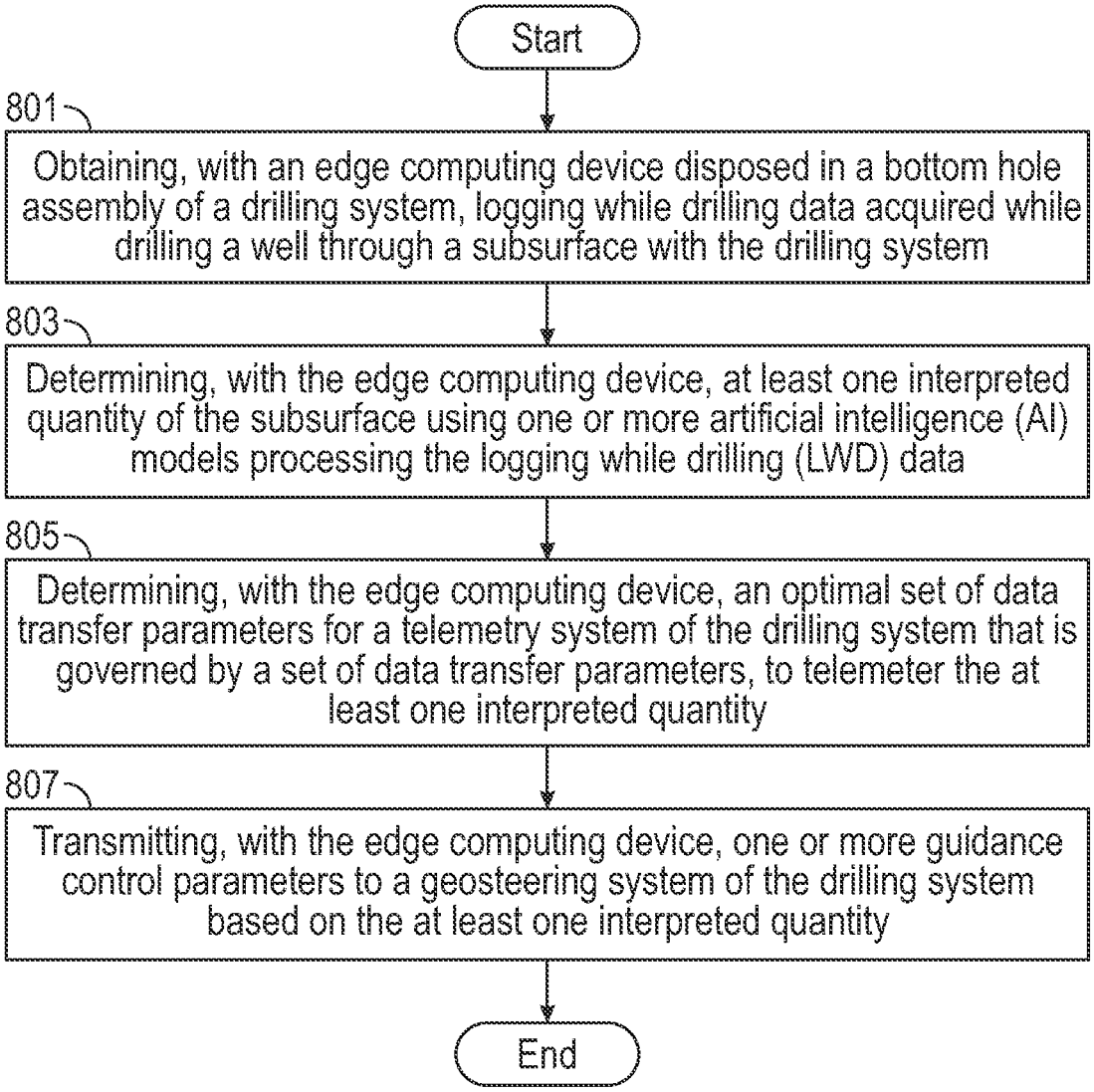
FIG. 8 depicts a flowchart in accordance with one or more embodiments.

FIG. 8 outlines a method of using the edge computing device (410) and data transfer optimizer (520), in accordance with one or more embodiments. In Block 801, the edge computing device (410), known as an edge device given its disposing in the BHA of a drilling system, obtains LWD data from a proximate (i.e., also disposed in the BHA) suite of logging while drilling tools. In one or more embodiments, the LWD data received directly from the suite of LWD tools is referenced as raw LWD data. Further, the raw LWD data may be associated with LWD metadata, where the LWD metadata is also obtained by the edge computing device (410). The LWD metadata includes, at least, information relating to the data type and data size of LWD logs of the raw LWD data. The LWD data includes at least one LWD log acquired using at least one LWD tool included in the suite of LWD tools. LWD logs included in the raw LWD data may include conventional triple combo well logs, such as gamma ray, in addition to resistivity, density, neutron porosity, sonic, pressure, temperature, caliper and nuclear magnetic resonance (NMR) data. In one or more embodiments, the edge computing device (410) filters the raw LWD data for outliers utilizing a z-value analysis. Additionally, in some embodiments, the raw LWD data are filtered utilizing a wavelet filtering approach to remove noise within the data.

Continuing with FIG. 8, in Block 803 the LWD data (which may be filtered and/or preprocessed (e.g., depth aligned, application of the time-depth merge algorithm, etc.) is processed by one or AI models with the edge computing device (410). The result of processing the LWD data with one or more AI models is the determination of at least one interpreted quantity. An interpreted quantity can include properties of the subsurface as a function of depth such as porosity, saturation, and lithology. In Block 805, the edge computing device (410) (or a data transfer optimizer (520) implemented on the edge computing device (410)) is used to determine an optimal set of data transfer parameters for a telemetry system of the drilling system. In general, data transmission by the telemetry system is governed by a set of data transfer parameters. As such, in Block 805, the optimal set of data transfer parameters are those parameters that when applied to the set of data transfer parameters result in the optimal data transmission using the telemetry system. In one or more embodiments, the telemetry system, configured according to the optimal set of data transfer parameters, is used to telemeter the at least one interpreted quantity from the BHA to the surface (i.e., to above ground installations). It is emphasized that LWD data is continually acquired while drilling and the processes depicted in FIG. 8 are continually applied to newly received LWD data. As such, the set of data transfer parameters is continually updated to the optimal set of data transfer parameters while the logging while drilling data is being acquired. In one or more embodiments, the optimal set of data transfer parameters are learned and updated using a reinforcement learner (e.g., Q-learner) guided by bandwidth and latency metrics evaluated while telemetering data from the BHA to the surface.

In Block 807, geosteering decision are made in real time, downhole without human intervention, based on the at least one interpreted quantity. The edge computing device (410) automatically adjusts one or more guidance control parameters, where the guidance control parameters guide and direct a drill bit of the drilling system along some wellbore path. As such, the edge computing device (410) determines, based on at least the at least one interpreted quantity, a wellbore path (or updates to the wellbore path) in real time and automatically adjusts the one or more guidance control parameters accordingly. Consequently, the edge computing device (410) enables autonomous and real time geosteering informed by LWD data acquired proximate the drill bit while performing a drilling operation.

Finally, it is again emphasized that the processes of FIG. 8 are continually applied during a drilling operation as LWD data is newly obtained as the drill bit traverses the subsurface. Further, the processes of FIG. 8 are implemented using an edge computing device (410) disposed within the BHA of the drilling system, the edge computing device (410) directly interfaced with other BHA systems such as a telemetry system and a suite of LWD tools. As such, evaluation of LWD logs (i.e., the determination of one or more subsurface properties from LWD logs), optimization of telemetered data, and geosteering can each be performed downhole and in real time.

Embodiments of the present disclosure may provide at least one of the following advantages. The edge computing device (410) enables downhole data processing transforming measurement signals of LWD logs to formation properties. Further, the formation properties can be used to support geosteering. The methods and systems disclosed herein allow for geosteering recommendations to be made downhole based on, among other things, raw LWD data (514) also processed downhole such that the geosteeering recommendations can be implemented autonomously in real time. The supported geosteering can enhance well placement, optimize reservoir contact, and/or ultimately increase recovery. In one or more embodiments, the methods and systems disclosed herein may be of particular interest for long horizontal wells, which often require geo-navigation in thin reservoir layers. Additionally, the real time and downhole determination of formation properties produces fit-for-purpose petrophysical models. The edge computing device (410) and data transfer optimizer (520) are computer language agnostic and are thus capable of running several programming languages and/or compilers. The edge computing device (410) and data transfer optimizer (520) optimize data transmitted from the BHA (114) to the surface where transmission occurs through a telemetry method governed by a set of data transfer parameters (532). The edge computing device (410) (and data transfer optimizer (520) if considered a separate entity) are disposed within the BHA (114) allowing for direct communication with the suite of LWD tools and the telemetry system (430).

Figure 9:
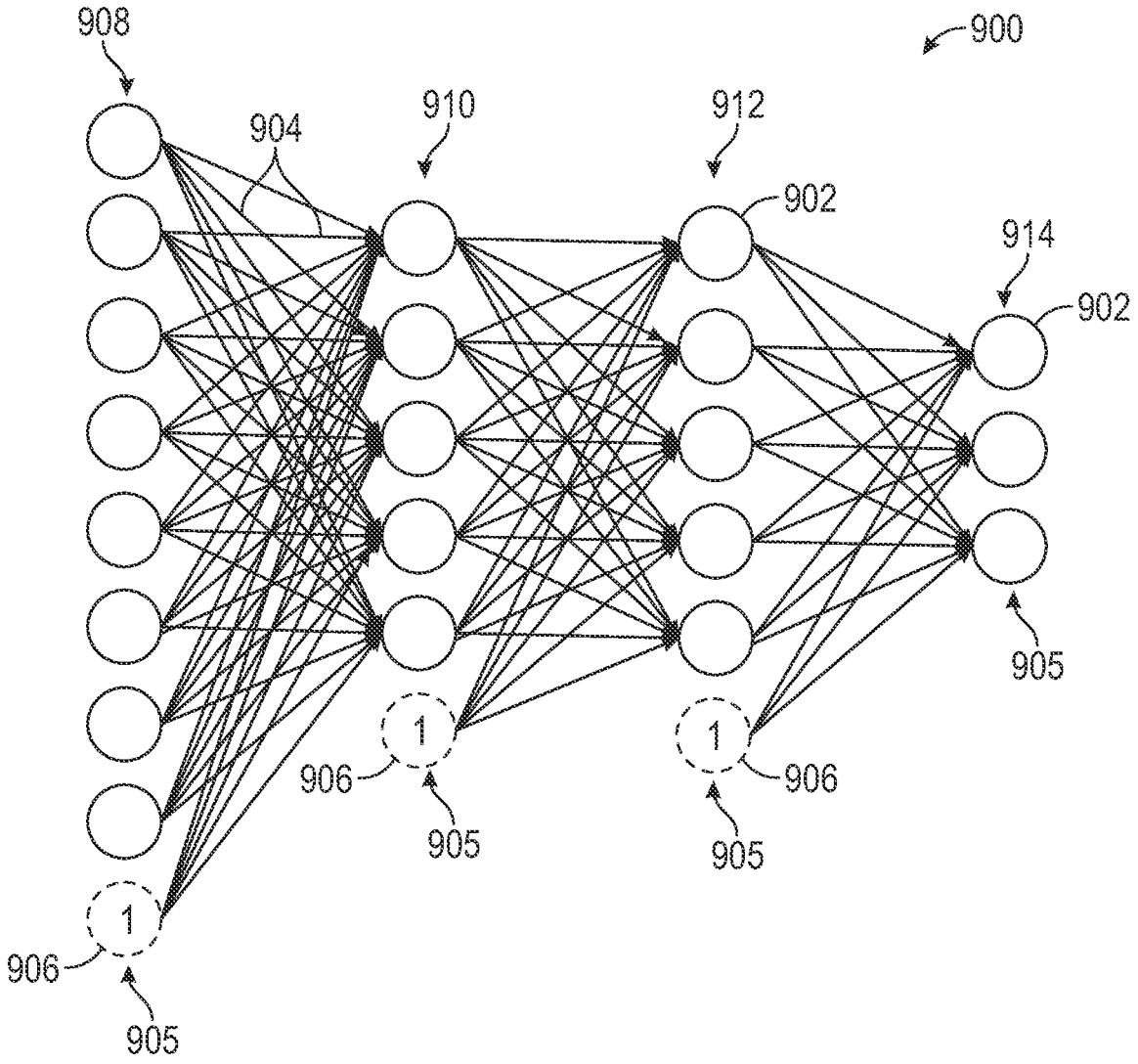
FIG. 9 depicts a neural network in accordance with one or more embodiments.

In accordance with one or more embodiments, any of the one or more AI models (512) and/or an AI model used by the data transfer optimizer (520) may be a neural network. A diagram of a neural network is shown in FIG. 9. At a high level, a neural network (900) may be graphically depicted as being composed of nodes (902), where here any circle represents a node, and edges (904), shown here as directed lines. The nodes (902) may be grouped to form layers (905). FIG. 9 displays four layers (908, 910, 912, 914) of nodes (902) where the nodes (902) are grouped into columns, however, the grouping need not be as shown in FIG. 9. The edges (904) connect the nodes (902). Edges (904) may connect, or not connect, to any node(s) (902) regardless of which layer (905) the node(s) (902) is in. That is, the nodes (902) may be sparsely and residually connected. A neural network (900) will have at least two layers (905), where the first layer (908) is considered the "input layer" and the last layer (914) is the "output layer." Any intermediate layer (910, 912) is usually described as a "hidden layer". A neural network (900) may have zero or more hidden layers (910, 912) and a neural network (900) with at least one hidden layer (910, 912) may be described as a "deep" neural network or as a "deep learning method." In general, a neural network (900) may have more than one node (902) in the output layer (914). In this case the neural network (900) may be referred to as a "multi-target" or "multi-output" network.

Nodes (902) and edges (904) carry additional associations. Namely, every edge is associated with a numerical value. The edge numerical values, or even the edges (904) themselves, are often referred to as "weights" or "parameters." While training a neural network (900), numerical values are assigned to each edge (904). Additionally, every node (902) is associated with a numerical variable and an activation function. Activation functions are not limited to any functional class, but traditionally follow the form:

$$A=f(\Sigma_{i\in(incoming)}[(\text{node value})_i(\text{edge value})_i]), \quad (1),$$

where i is an index that spans the set of "incoming" nodes (902) and edges (904) and $f$ is a user-defined function. Incoming nodes (902) are those that, when viewed as a graph (as in FIG. 9), have directed arrows that point to the node (902) where the numerical value is being computed. Some functions for $f$ may include the linear function $f(x)=x$, sigmoid function $f(x)=1/1+e^{-x}$, and rectified linear unit function $f(x)=\max(0, x)$, however, many additional functions are commonly employed. Every node (902) in a neural network (900) may have a different associated activation function. Often, as a shorthand, activation functions are described by the function $f$ by which it is composed. That is, an activation function composed of a linear function $f$ may simply be referred to as a linear activation function without undue ambiguity.

When the neural network (900) receives an input, the input is propagated through the network according to the activation functions and incoming node (902) values and edge (904) values to compute a value for each node (902). That is, the numerical value for each node (902) may change for each received input. Occasionally, nodes (902) are assigned fixed numerical values, such as the value of 1, that are not affected by the input or altered according to edge (904) values and activation functions. Fixed nodes (902) are often referred to as "biases" or "bias nodes" (906), displayed in FIG. 9 with a dashed circle.

In some implementations, the neural network (900) may contain specialized layers (905), such as a normalization layer, or additional connection procedures, like concatenation. One skilled in the art will appreciate that these alterations do not exceed the scope of this disclosure.

As noted, the training procedure for the neural network (900) comprises assigning values to the edges (904). To begin training the edges (904) are assigned initial values. These values may be assigned randomly, assigned according to a prescribed distribution, assigned manually, or by some other assignment mechanism. Once edge (904) values have been initialized, the neural network (900) may act as a function, such that it may receive inputs and produce an output. As such, at least one input is propagated through the neural network (900) to produce an output. Recall, that a given data set will be composed of inputs and associated target(s), where the target(s) represent the "ground truth," or the otherwise desired output. In accordance with one or more embodiments, the input of the neural network is an LWD log (e.g., gamma ray (202)) and the target is a formation property (e.g., lithology).

The neural network (900) output is compared to the associated input data target(s). The comparison of the neural network (900) output to the target(s) is typically performed by a so-called "loss function;" although other names for this comparison function such as "error function," "misfit function," and "cost function" are commonly employed. Many types of loss functions are available, such as the mean-squared-error function, however, the general characteristic of a loss function is that the loss function provides a numerical evaluation of the similarity between the neural network (900) output and the associated target(s). The loss function may also be constructed to impose additional constraints on the values assumed by the edges (904), for example, by adding a penalty term, which may be physics-based, or a regularization term. Generally, the goal of a training procedure is to alter the edge (904) values to promote similarity between the neural network (900) output and associated target(s) over the data set. Thus, the loss function is used to guide changes made to the edge (904) values, typically through a process called "backpropagation."

While a full review of the backpropagation process exceeds the scope of this disclosure, a brief summary is provided. Backpropagation consists of computing the gradient of the loss function over the edge (904) values. The gradient indicates the direction of change in the edge (904) values that results in the greatest change to the loss function. Because the gradient is local to the current edge (904) values, the edge (904) values are typically updated by a "step" in the direction indicated by the gradient. The step size is often referred to as the "learning rate" and need not remain fixed during the training process. Additionally, the step size and direction may be informed by previously seen edge (904) values or previously computed gradients. Such methods for determining the step direction are usually referred to as "momentum" based methods.

Once the edge (904) values have been updated, or altered from their initial values, through a backpropagation step, the neural network (900) will likely produce different outputs. Thus, the procedure of propagating at least one input through the neural network (900), comparing the neural network (900) output with the associated target(s) with a loss function, computing the gradient of the loss function with respect to the edge (904) values, and updating the edge (904) values with a step guided by the gradient, is repeated until a termination criterion is reached. Common termination criteria are: reaching a fixed number of edge (904) updates, otherwise known as an iteration counter; a diminishing learning rate; noting no appreciable change in the loss function between iterations; reaching a specified performance metric as evaluated on the data or a separate hold-out data set. Once the termination criterion is satisfied, and the edge (904) values are no longer intended to be altered, the neural network (900) is said to be "trained".

Figure 10:
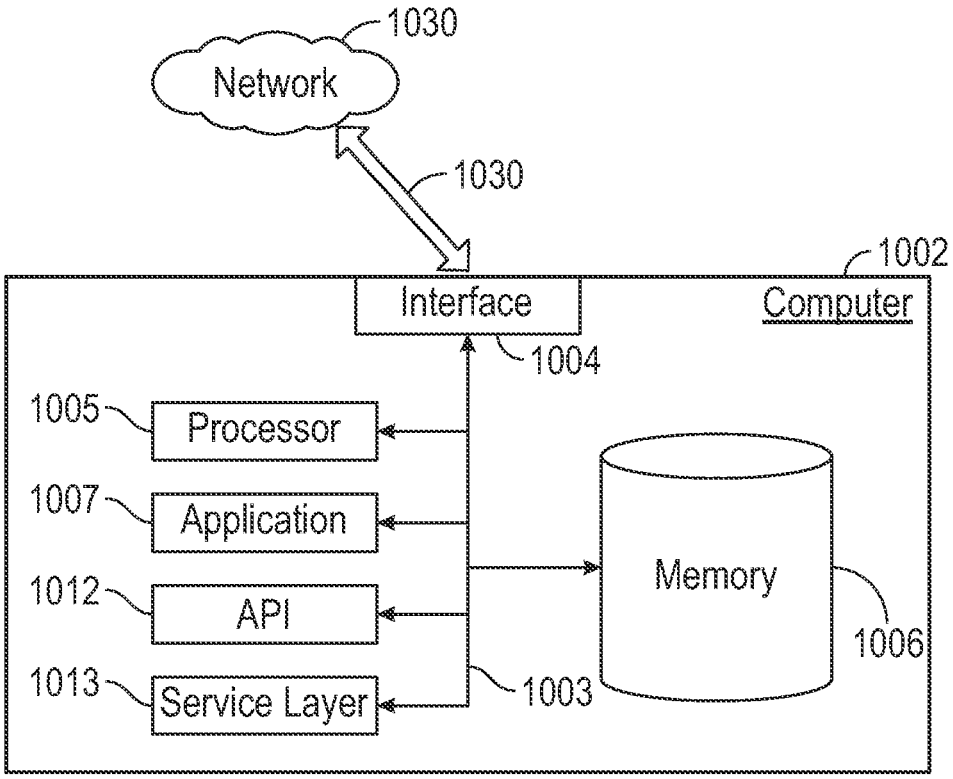
FIG. 10 depicts a system in accordance with one or more embodiments.

Embodiments disclosed herein may be implemented on a computer system, or the edge computing device (410) itself may be considered a computer system. FIG. 10 is a block diagram of a computer system (1002) used to provide computational functionalities associated with described algorithms, methods, functions, processes, flows, and procedures as described in the instant disclosure, according to one or more embodiments. The illustrated computer (1002) is intended to encompass any computing device such as a server, desktop computer, laptop/notebook computer, wireless data port, smart phone, personal data assistant (PDA), tablet computing device, one or more processors within these devices, or any other suitable processing device such as an edge computing device, including both physical or virtual instances (or both) of the computing device. An edge computing device is a dedicated computing device that is, typically, physically adjacent to the process or control with which it interacts. For example, the AI model may be implemented on an edge computing device in order to quickly provide optimal sets of well operational parameters and lithium extraction configuration parameters to associated field devices or their controllers (e.g., control system).

Additionally, the computer (1002) may include a computer that includes an input device, such as a keypad, keyboard, touch screen, or other device that can accept user information, and an output device that conveys information associated with the operation of the computer (1002), including digital data, visual, or audio information (or a combination of information), or a GUI.

The computer (1002) can serve in a role as a client, network component, a server, a database or other persistency, or any other component (or a combination of roles) of a computer system for performing the subject matter described in the instant disclosure. In some implementations, one or more components of the computer (1002) may be configured to operate within environments, including cloud-computing-based, local, global, or other environment (or a combination of environments).

At a high level, the computer (1002) is an electronic computing device operable to receive, transmit, process, store, or manage data and information associated with the described subject matter. According to some implementations, the computer (1002) may also include or be communicably coupled with an application server, e-mail server, web server, caching server, streaming data server, business intelligence (BI) server, or other server (or a combination of servers).

The computer (1002) can receive requests over network (1030) from a client application (for example, executing on another computer (1002) and responding to the received requests by processing the said requests in an appropriate software application. In addition, requests may also be sent to the computer (1002) from internal users (for example, from a command console or by other appropriate access method), external or third-parties, other automated applications, as well as any other appropriate entities, individuals, systems, or computers.

Each of the components of the computer (1002) can communicate using a system bus (1003). In some implementations, any or all of the components of the computer (1002), both hardware or software (or a combination of hardware and software), may interface with each other or the interface (1004) (or a combination of both) over the system bus (1003) using an application programming interface (API) (1012) or a service layer (1013) (or a combination of the API (1012) and service layer (1013). The API (1012) may include specifications for routines, data structures, and object classes. The API (1012) may be either computer-language independent or dependent and refer to a complete interface, a single function, or even a set of APIs. The service layer (1013) provides software services to the computer (1002) or other components (whether or not illustrated) that are communicably coupled to the computer (1002). The functionality of the computer (1002) may be accessible for all service consumers using this service layer. Software services, such as those provided by the service layer (1013), provide reusable, defined business functionalities through a defined interface. For example, the interface may be software written in JAVA, C++, or other suitable language providing data in extensible markup language (XML) format or another suitable format. While illustrated as an integrated component of the computer (1002), alternative implementations may illustrate the API (1012) or the service layer (1013) as stand-alone components in relation to other components of the computer (1002) or other components (whether or not illustrated) that are communicably coupled to the computer (1002). Moreover, any or all parts of the API (1012) or the service layer (1013) may be implemented as child or sub-modules of another software module, enterprise application, or hardware module without departing from the scope of this disclosure.

The computer (1002) includes an interface (1004). Although illustrated as a single interface (1004) in FIG. 10, two or more interfaces (1004) may be used according to particular needs, desires, or particular implementations of the computer (1002). The interface (1004) is used by the computer (1002) for communicating with other systems in a distributed environment that are connected to the network (1030). Generally, the interface (1004) includes logic encoded in software or hardware (or a combination of software and hardware) and operable to communicate with the network (1030). More specifically, the interface (1004) may include software supporting one or more communication protocols associated with communications such that the network (1030) or interface's hardware is operable to communicate physical signals within and outside of the illustrated computer (1002).

The computer (1002) includes at least one computer processor (1005). Although illustrated as a single computer processor (1005) in FIG. 10, two or more processors may be used according to particular needs, desires, or particular implementations of the computer (1002). Generally, the computer processor (1005) executes instructions and manipulates data to perform the operations of the computer (1002) and any algorithms, methods, functions, processes, flows, and procedures as described in the instant disclosure.

The computer (1002) also includes a memory (1006) that holds data for the computer (1002) or other components (or a combination of both) that can be connected to the network (1030). The memory may be a non-transitory computer readable medium. For example, memory (1006) can be a database storing data consistent with this disclosure. Although illustrated as a single memory (1006) in FIG. 10, two or more memories may be used according to particular needs, desires, or particular implementations of the computer (1002) and the described functionality. While memory (1006) is illustrated as an integral component of the computer (1002), in alternative implementations, memory (1006) can be external to the computer (1002).

The application (1007) is an algorithmic software engine providing functionality according to particular needs, desires, or particular implementations of the computer (1002), particularly with respect to functionality described in this disclosure. For example, application (1007) can serve as one or more components, modules, applications, etc. Further, although illustrated as a single application (1007), the application (1007) may be implemented as multiple applications (1007) on the computer (1002). In addition, although illustrated as integral to the computer (1002), in alternative implementations, the application (1007) can be external to the computer (1002).

There may be any number of computers (1002) associated with, or external to, a computer system containing computer (1002), wherein each computer (1002) communicates over network (1030). Further, the term "client," "user," and other appropriate terminology may be used interchangeably as appropriate without departing from the scope of this disclosure. Moreover, this disclosure contemplates that many users may use one computer (1002), or that one user may use multiple computers (1002).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

obtaining, with an edge computing device disposed in a bottom hole assembly of a drilling system, logging while drilling (LWD) data acquired while drilling a well through a subsurface with the drilling system;

obtaining a tool uncertainty for each of one or more LWD logs comprised by the LWD data;

determining, with the edge computing device, at least one interpreted quantity of the subsurface using one or more artificial intelligence (AI) models processing the LWD data, wherein the tool uncertainty for each LWD log is propagated through the one or more AI models to obtain an uncertainty estimate for the at least one interpreted quantity;

determining, with the edge computing device, an optimal set of data transfer parameters for a telemetry system of the drilling system configured with a set of data transfer parameters, to telemeter the at least one interpreted quantity, wherein the set of data transfer parameters are continually updated to the optimal set of data transfer parameters while the logging while drilling data is being acquired; and transmitting, with the edge computing device, one or more guidance control parameters to a geosteering system of the drilling system based on the at least one interpreted quantity and the uncertainty estimate.

2. The method of claim 1, wherein the one or more guidance control parameters define a wellbore path for a wellbore drilled by the drilling system.

3. The method of claim 1, wherein the at least one interpreted quantity is a lithology of the subsurface as a function of depth of the well.

4. The method of claim 1, wherein the one or more AI models comprises a neural network.

5. The method of claim 1, wherein determining the optimal set of data transfer parameters comprises adjusting the set of data transfer parameters with a reinforcement learner while monitoring a bandwidth and a latency of telemetered data using the telemetry system configured with the set of data transfer parameters.

6. The method of claim 1, further comprising:

obtaining, with the edge computing device, LWD metadata corresponding to the LWD data, wherein the at least one interpreted quantity comprises a first subsurface property and the one or more AI models comprises a first AI model, wherein the first subsurface property is determined by processing at least one LWD log comprised by the LWD data with the first AI model, wherein the first AI model is selected to process the at least one LWD log based on the LWD metadata.

7. The method of claim 5, wherein the reinforcement learner is a Q-learner.

8. A non-transitory computer-readable memory comprising computer-executable instructions stored thereon that, when executed on a processor, cause the processor to perform steps comprising:

obtaining logging while drilling (LWD) data acquired while drilling a well through a subsurface with a drilling system;

obtaining a tool uncertainty for each of one or more LWD logs comprised by the LWD data;

determining at least one interpreted quantity of the subsurface using one or more artificial intelligence (AI) models processing the LWD data, wherein the tool uncertainty for each LWD log is propagated through the one or more AI models to obtain an uncertainty estimate for the at least one interpreted quantity;

determining an optimal set of data transfer parameters for a telemetry system of the drilling system configured with a set of data transfer parameters, to telemeter the at least one interpreted quantity, wherein the set of data transfer parameters are continually updated to the optimal set of data transfer parameters while the logging while drilling data is being acquired; and transmitting one or more guidance control parameters to a geosteering system of the drilling system based on the at least one interpreted quantity and the uncertainty estimate.

9. The non-transitory computer-readable memory of claim 8, wherein the one or more guidance control parameters define a wellbore path for a wellbore drilled by the drilling system.

10. The non-transitory computer-readable memory of claim 8, wherein the at least one interpreted quantity is a lithology of the subsurface as a function of depth of the well.

11. The non-transitory computer-readable memory of claim 8, wherein the one or more AI models comprises a neural network.

12. The non-transitory computer-readable memory of claim 8, wherein determining the optimal set of data transfer parameters comprises adjusting the set of data transfer parameters with a reinforcement learner while monitoring a bandwidth and a latency of telemetered data using the telemetry system configured with the set of data transfer parameters.

13. The non-transitory computer-readable memory of claim 8, wherein the computer-executable instructions, when executed on the processor, further cause the processor to perform steps:

obtaining LWD metadata corresponding to the LWD data, wherein the at least one interpreted quantity comprises a first subsurface property and the one or more AI models comprises a first AI model, wherein the first subsurface property is determined by processing at least one LWD log comprised by the LWD data with the first AI model, wherein the first AI model is selected to process the at least one LWD log based on the LWD metadata.

14. A system, comprising:

a drilling system comprising a bottom hole assembly comprising:

a drill bit to drill a well in a subsurface, a suite of logging while drilling (LWD) tools comprising at least one LWD tool proximate the drill bit, an edge computing device configured to obtain LWD data from the suite of LWD tools while drilling the well through the subsurface with the drilling system and to obtain a tool uncertainty for each of the at least one LWD tool, and a telemetry system configured with a set of data transfer parameters and configured to telemeter data from the bottom hole assembly to a surface;

wherein the edge computing device is further configured to:

determine at least one interpreted quantity of the subsurface using one or more artificial intelligence (AI) models processing the LWD data, wherein the tool uncertainty for each LWD tool is propagated through the one or more AI models to obtain an uncertainty estimate for the at least one interpreted quantity, determine an optimal set of data transfer parameters for the telemetry system to telemeter the at least one interpreted quantity, and transmit, one or more guidance control parameters to a geosteering system of the drilling system based on the at least one interpreted quantity and the uncertainty estimate.

15. The system of claim 14, wherein the one or more guidance control parameters define a wellbore path for the well drilled by the drilling system.

16. The system of claim 14, wherein the at least one interpreted quantity is a lithology of the subsurface as a function of depth of the well.

17. The system of claim 14, wherein determining the optimal set of data transfer parameters comprises adjusting the set of data transfer parameters with a reinforcement learner while monitoring a bandwidth and a latency of telemetered data using the telemetry system configured with the set of data transfer parameters.

* * * * *